United States Patent [19]

de Lassat de Pressigny et al.

[11] Patent Number: 4,700,930

[45] Date of Patent: Oct. 20, 1987

[54] DEVICE FOR INJECTING PULVERULENT MATERIAL, SUCH AS COAL, IN A BLAST FURNACE

[75] Inventors: Yann de Lassat de Pressigny, Metz; Michel Schneider, Semecourt, both of France

[73] Assignee: Institut de Recherches de la Sidergie Francaise Irsid, Maizieres-Les-Metz, France

[21] Appl. No.: 851,204

[22] Filed: Apr. 14, 1986

[30] Foreign Application Priority Data

Apr. 15, 1985 [FR] France ..... 85 05635

[51] Int. Cl.[4] ..... C21B 7/16

[52] U.S. Cl. ..... 266/267; 75/42

[58] Field of Search ..... 266/267, 182; 75/42, 75/41

[56] References Cited

U.S. PATENT DOCUMENTS

| | | | |
|---|---|---|---|
| 3,166,621 | 1/1965 | Carlson | 266/41 |
| 3,558,119 | 1/1971 | Demalander | 75/42 |
| 4,278,367 | 7/1981 | Jacobson | 406/109 |
| 4,490,171 | 12/1984 | Suzuki et al. | 75/42 |

FOREIGN PATENT DOCUMENTS

| | | |
|---|---|---|
| 1433317 | 11/1968 | Fed. Rep. of Germany . |
| 577454 | 9/1924 | France . |
| 586015 | 3/1925 | France . |
| 1348667 | 12/1964 | France . |
| 2501833 | 3/1981 | France . |

*Primary Examiner*—Melvyn J. Andrews
*Attorney, Agent, or Firm*—Staas & Halsey

[57] ABSTRACT

The invention relates to a device for injecting pulverulent material, such as coal, into a blast furnace. The device includes a hot blast tuyere issuing into the blast furnace, a nozzle fixed against said tuyere and co-axial thereto for bringing the hot blast, a branch connection produced obliquely on the nozzle and directed towards the tuyere, and an injection pipe traversing the branch connection to issue into the tuyere. According to the invention, the injection pipe is substantially an arc of circle, the convexity of which is directed towards the axis of the nozzle and of the tuyere. The radius of curvature is at least equal to one hundred times its inner diameter.

11 Claims, 5 Drawing Figures

Fig-2A
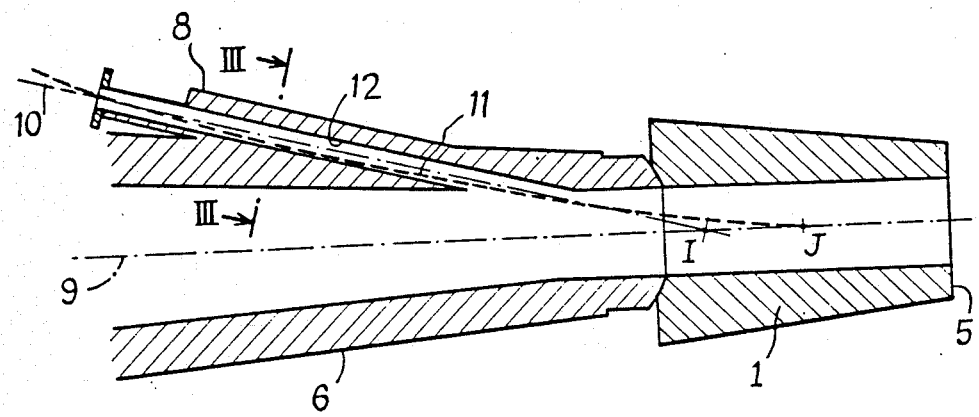
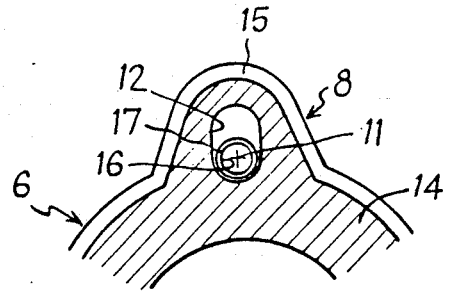
Fig-3A

DEVICE FOR INJECTING PULVERULENT MATERIAL, SUCH AS COAL, IN A BLAST FURNACE

BACKGROUND OF THE INVENTION

The invention relates to the injection of pulverulent materials in a blast furnace, and in particular coal.

It is well known that injecting powdered coal into a blast furnace reduces the coke consumption. The coal is introduced through an injection pipe into the hot blast coming from the Cowper stoves.

Such known injection devices comprise a hot blast tuyere issuing into the blast furnace, a nozzle fixed against said tuyere and co-axial thereto for bringing the hot blast, a branch connection produced obliquely on the nozzle and directed towards the tuyere, and an injection pipe traversing said branch connection to issue into the tuyere. In these known devices, the injection pipe is a straight pipe of which the inclination with respect to the axis of the tuyere is the same as that of the branch connection of the nozzle, namely generally 15°.

It has been found that this technology, though being satisfactory in many ways, presents however the disadvantage of lacking suppleness. More specifically, it is not really easy, when using said technology, to alter the position of the discharge end of the injection pipe with respect to the tuyere. Yet that position is difficult to choose since it is dependent on parameters which are in contradiction. According to some parameters, it is preferable for the injection pipe to penetrate as far as possible into the tuyere, whereas according to the others, the injection pipe should not penetrate too much. With the straight injection pipe inclined at 15°, it is not possible, without problems arising as to the quality of the injection, to depart from the normal position.

SUMMARY OF THE INVENTION

It is an object of the invention to propose a new injection device which is more supple and permits the exploration of a larger part of the tuyere when choosing the ideal position for the discharge end of the injection pipe.

This object is reached due to the fact that the axis of the injection pipe is substantially an arc of circle, the convexity of which is directed towards the axis of the nozzle and of the tuyere. Indeed, owing to the curved design of the injection pipe, it is possible, by an adequate pivoting movement of said pipe about its center of curvature, to cause it to penetrate quite deeply inside the tuyere while preserving a suitable inclination of the end of the pipe on the axis of the tuyere.

In order to prevent premature wearing of the injection pipe, the radius of curvature should advantageously be at least equal to one hundred times its inner diameter.

In any case, too small a radius of curvature would not allow housing of the pipe in the conventional arrangement of the tuyere and of the adjoining members, or its extraction therefrom.

A long enough radius of curvature presents the added advantage of providing a branch connection on the nozzle, the inner passage of which has a cross-section permitting the insertion either of, indifferently, a straight pipe or a curved pipe.

Even greater advantages can be expected from the invention, when, conventionally, an electron torch is used to superheat the hot blast coming from the Cowper stoves, and to make the blast furnace more economical in general.

Such superheating indeed causes the coal to burn quicker (virtually as soon as it comes out of the injection pipe) so that a double problem then arises, of the resistance to heat of the injection pipe itself and of the tuyere.

According to the invention, the curved injection pipe adaptation enables the orifice of the pipe to advance deeper into the tuyere, thus preventing any problems related to excessive temperatures (and to the mechanical abrasion of coal).

Advantageously also, a system is provided for cooling the injection pipe as well as for cooling the nozzle and its branch connection.

BRIEF DESCRIPTION OF THE DRAWINGS

The invention will be more readily understood on reading the following description with reference to the accompanying drawings, in which:

FIG. 2A is a diagrammatical longitudinal section showing the tuyere, the nozzle, the nozzle branch connection and the respective location of the axes of a conventional injection pipe and of an injection pipe according to the invention (for reasons of clarity, the injection pipes are represented by their axis and not by their real outline);

FIG. 3A is a cross-section along line III—III of FIG. 2A, showing the shape of the inner passage of the branch connection of the nozzle and of the injection pipe housed therein.

DESCRIPTION OF THE PREFERRED EMBODIMENTS

Figure 1:
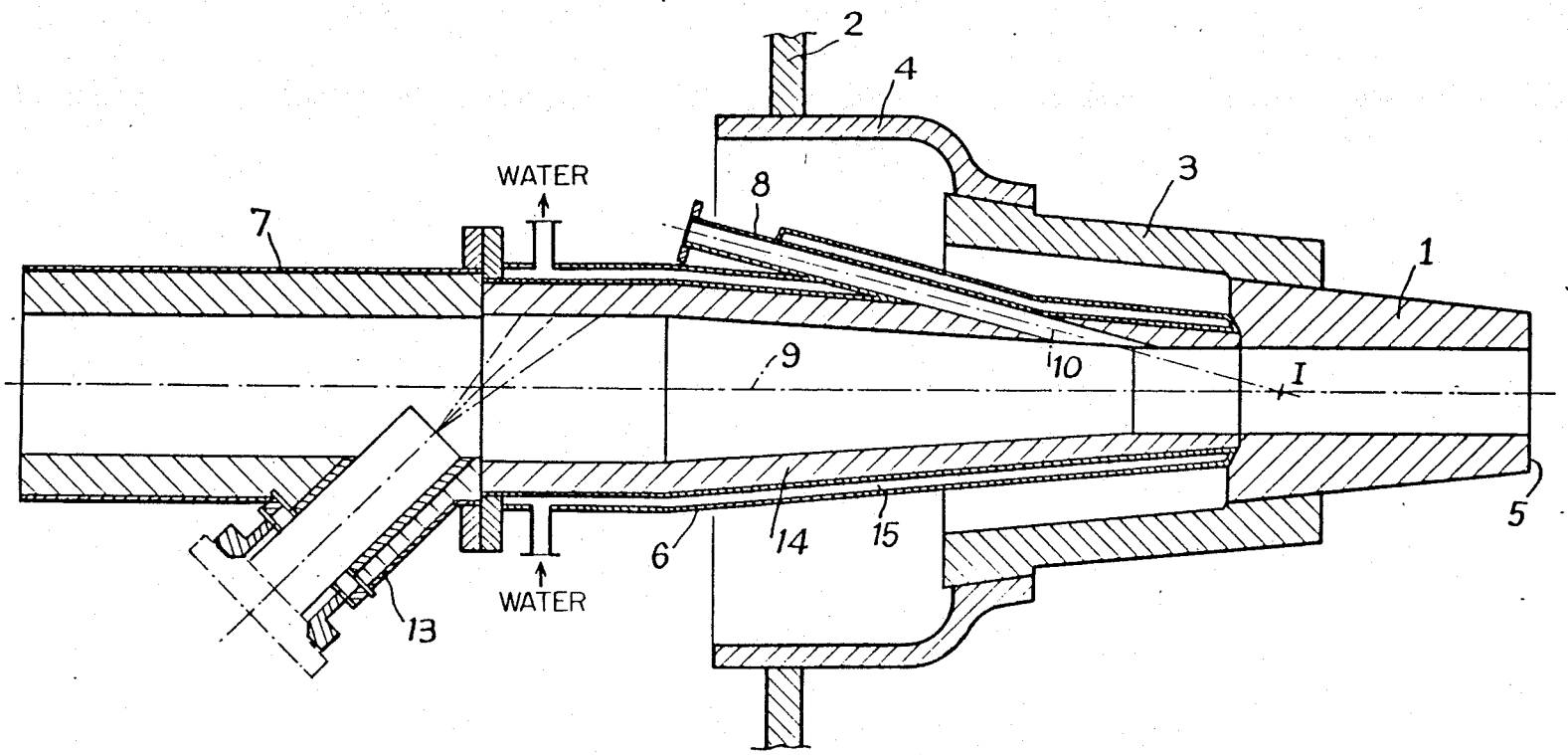
FIG. 1 is a longitudinal section of a blast furnace tuyere and its related members, into which is inserted the device according to the invention.

Referring first to FIG. 1, this shows the blast tuyere 1 fixed in conventional manner on the shell 2 of the blast furnace by means of the tymp 3 and jacket 4.

The nose 5 of the tuyere 1 issues inside the blast furnace above the well.

The nozzle 6, blocked against a spherical bearing surface at the back of the tuyere 1, extends co-axially from said tuyere, bringing in the hot blast that it receives from the goose-neck 7 and from the other blast-feeding means conventionally used in blast furnaces.

The nozzle 6 is provided with an oblique branch connection 8, inclined so as to form an angle of 15° with the axis 9 of the nozzle and of the tuyere, and provided for inserting an injection pipe.

According to the prior technique, the injection pipe is a straight pipe of which the axis is coincident with or parallel to the axis 10 of the branch connection piece 8. Said injection pipe issues into the tuyere, at the level of the intersecting point of axes 9 and 10, which means that said injection pipe penetrates into the tuyere over a distance of at the most 7 cm, compared with the 50 or 60 cm-length of said tuyere.

Figure 2B:
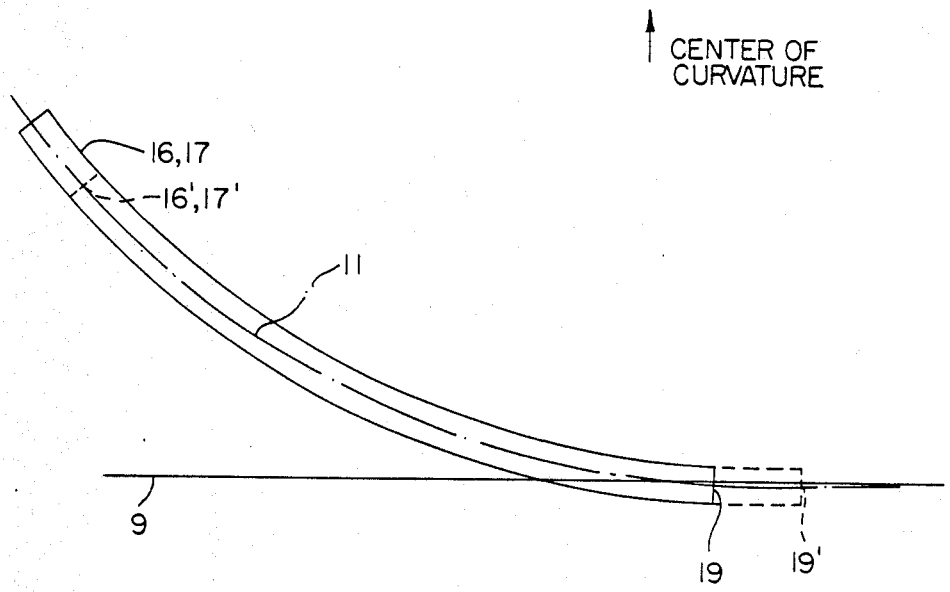
FIG. 2B illustrates pivoting movement of the pipe and indicates the direction of the center of curvature.

According to the invention, the injection pipe is curved, as shown by its axis 11 represented in dashed line in FIG. 2A. Said axis forms an arc of circle of radius at least equal to one hundred times the inner diameter of the pipe, in order to prevent the problems of the pipe wearing due to the coal circulating therein.

By way of example, according to a particular embodiment of the invention, the injection pipe has an inner diameter of 20 mm, and the radius of curvature is of 3200 mm.

Because of said curvature of the injection pipe, it is possible for said pipe to issue at point J of intersection of axes 9 and 11 situated inside the tuyere, further down than point I (44.5 cm instead of 7 cm according to the aforesaid special embodiment). Moreover, said injection pipe issues therein at a smaller angle than the angle of inclination (15°) of axis 10 on axis 9, this proving very suitable for the normal implementation of the injection method, and also for its initial control or testing.

Indeed, it is possible to move the injection pipe (by pivoting it about its center of curvature) so that its axis 11 stays always on the same circle, the outlet orifice of said injection pipe moving more or less apart from point J, either forward or backward. This movement of the pipe 16, 17 and 19 from one position to another position 16', 17' and 19' varies the position while keeping the outlet 19 near the axis 9 of the tuyere. In all cases, the injection pipe issues into the tuyere at an angle smaller than the angle of inclination of axis 10. It is thus possible, within an adjusting range of about one meter, to try a whole range of positions for the outlet orifice of the injection pipe, keeping it always relatively close to the axis of the tuyere, but varying its depth of penetration therein. This finds a compromise between the contrary factors ruling the choice of an ideal position; on the one hand, for a reduction of the abrasion of the tuyere walls by the coal, the tendency is to place the outlet orifice of the injection pipe further inside; and on the other hand, for a quicker and more complete burning of the coal with the oxygen which remains available, the tendency is to pull back the outlet orifice of the injection pipe.

The cross-section of the inner passage 12 of the branch connection 8 of the nozzle is advantageously as illustrated in FIG. 3A, namely formed by two half-circles, joined up by two straight parts. According to the aforesaid embodiment, the radius of said two half-circles and the length of the straight parts is 25 mm.

According to this design, it is possible to introduce in the same nozzle, either the injection pipe according to the invention or one of the conventional straight pipes.

The invention finds a particularly advantageous application when, in manner known per se, an electron torch 13 (FIG. 1) is used for superheating the air blast. The nozzle 6 is lined with a refractory 14 and equipped with a water-cooling system (FIGS. 1 and 3A).

The high temperature causes the coal to burn as soon as it comes out of the injection pipe. Therefore it is important, in order to preserve the resistance of the tuyere to insert the outlet of said pipe deeper into the tuyere, contrary to the conventional implantation of a rigid pipe. The curved injection pipe according to the invention precisely solves this problem.

Figure 3B:
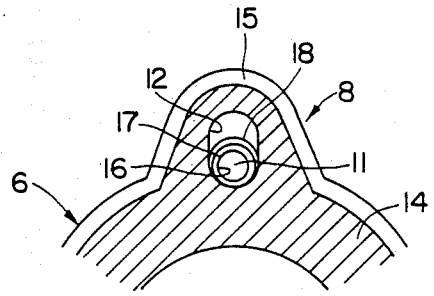
FIG. 3B illustrates a double annular jacket through which water circulates.

Said curved pipe must also be able to withstand the high temperatures encountered when an electron torch is used. Therefore a pipe cooling system must be provided, such as for example any one of the three following arrangements:

According to a first version, the central conduit of the injection pipe through which flows the mixture of air and coal, is covered over with a double annular jacket, including outer annular chamber 18 and inner chamber 17 as illustrated in FIG. 3B, through which circulates water. Considering the small amount of space available, the cooling system is a water streak system (water thickness about 2 mm): the same de-ionized ultra-pure water as used for cooling the electron torch will be advantageously used to this effect.

According to a second version, the central conduit of the injection pipe is surrounded by an annular chamber for injecting air at a high rate (for example 83 m3/hour).

According to a third version, the central conduit 16 (FIG. 3) is surrounded by an annular chamber 17 into which is injected a liquid hydrocarbon.

What is claimed is:

1. A device for injecting pulverulent material into a blast furnace, comprising:

a hot blast tuyere having a straight axis and issuing into the blast furnace, a nozzle fixed against said tuyere, having the same axis as said tuyere and for bringing the hot blast, a branch connection produced obliquely on the nozzle and directed towards the tuyere, and an injection pipe having a central axis traversing said branch connection and having an outlet orifice issuing into said tuyere, the central axis of said injection pipe being substantially an arc of a circle with a convexity directed towards the axis of the nozzle and of the tuyere, said injection pipe pivoting about the center of curvature of the central axis and the axial location of the outlet orifice varying through a range of axial positions while keeping close to the axis of the nozzle and the tuyere.

2. A device as claimed in claim 1, wherein the central axis has a radius of curvature at least equal to one hundred times an inner diameter of said injection pipe.

3. A device as claimed in claim 1, wherein the injection pipe is surrounded by cooling means for cooling the injection pipe.

4. A device as claimed in claim 3, wherein said cooling means comprises a double annular jacket around said injecting pipe with water circulating therein.

5. A device as claimed in claim 3, wherein said cooling means comprises an annular chamber around said injection pipe with high velocity air injected therein.

6. A device as claimed in claim 3, wherein said cooling means comprises an annular chamber surrounding said injection pipe with a liquid hydrocarbon injected therein.

7. A device as claimed in claim 1, wherein the branch connection of the nozzle is provided with cooling means for cooling the branch connection.

8. A device as claimed in claim 1, further including an electron torch upstream of the nozzle.

9. A device for injecting pulverulent material into a blast furnace through a tuyere, comprising:

a nozzle having an axis and discharging coaxially through the tuyere into the blast furnace; and injection means, penetrating the nozzle, for adjustably injecting the pulverulent material into the nozzle over a range of nozzle axial positions and maintaining an injection point substantially on the nozzle axis across the range of positions.

10. A device as claimed in claim 9, wherein said injection means comprises a curved pivoting injection pipe penetrating the nozzle and having an outlet that moves substantially parallel to the nozzle axis as the pipe is pivoted while the outlet is maintained substantially on the nozzle axis.

11. A device as recited in claim 10, wherein said pipe has an inner diameter and a radius of curvature greater than or equal to one hundred times the inner diameter.

* * * * *